US006910821B1

(12) United States Patent
Smith

(10) Patent No.: US 6,910,821 B1
(45) Date of Patent: Jun. 28, 2005

(54) RING PEN DEVICE

(76) Inventor: Otis Smith, 182 Laurel Bay Rd., Beaufort, SC (US) 29906

( * ) Notice: Subject to any disclaimer, the term of this patent is extended or adjusted under 35 U.S.C. 154(b) by 45 days.

(21) Appl. No.: 10/929,982

(22) Filed: Aug. 30, 2004

(51) Int. Cl.[7] ..... A46B 5/02
(52) U.S. Cl. ..... 401/8
(58) Field of Search ..... 401/6–8

(56) References Cited

U.S. PATENT DOCUMENTS

| | | | | |
|---|---|---|---|---|
| 684,685 | A | 10/1901 | Gerst | |
| 2,509,837 | A | 5/1950 | Niizawa | |
| D253,416 | | 11/1979 | MacIntosh | |
| 5,314,260 | A | 5/1994 | Andersson | |
| 5,405,206 | A | 4/1995 | Bedol | |
| 5,529,415 | A | 6/1996 | Bishop | |
| 5,868,509 | A * | 2/1999 | Crutcher | 401/8 |
| 5,971,642 | | 10/1999 | O'Mara et al. | |
| 6,320,570 | | 11/2001 | Robb | |
| 6,533,480 | | 3/2003 | Schneider | |
| 6,594,871 | | 7/2003 | Hoffman | |
| 6,626,598 | | 9/2003 | Schneider | |

* cited by examiner

*Primary Examiner*—Tuan Nguyen
(74) *Attorney, Agent, or Firm*—Harleston Law Firm LLC; Kathleen M. Harleston

(57) ABSTRACT

A ring pen device convertible between a use as a finger ring and a writing implement includes: (a) a ring hull; (b) a hull insert that is insertable within the ring hull, the hull insert including a channel; and (c) an extendible pen assembly in the hull insert, the pen assembly including at least one marking tube; wherein the pen assembly has a retracted position within the hull insert, and an extended position in which a portion of the marking tube extends from an end of the channel in the hull insert. The pen assembly preferably includes a slide bar with at least one pair of matching stops extending from it, and at least one marking tube adjacent the slide bar, each slide bar stop being removably engageable with at least one of the notches.

20 Claims, 13 Drawing Sheets

RING PEN DEVICE

CROSS REFERENCE TO RELATED DOCUMENT

This invention was described in Disclosure Document Number 550367, which was received by the U.S. Patent & Trademark Office on Mar. 31, 2004.

BACKGROUND OF THE INVENTION

1. Technical Field

The present invention relates to a ring pen device with a retractable, insertable pen assembly or the like that can be worn on the finger as a conventional finger ring, or removed and used as a writing implement.

2. Background Information

Oftentimes, a conventional pen will leak ink into the shirt pocket where it is kept, or onto adjacent items in a handbag or briefcase. This can ruin an expensive shirt or handbag. Also, a forgotten pen left in a student's pants pocket, for example, can leak in the washing machine. Men, women, and children have a tendency to misplace conventional pens in their pockets, handbags, book bags, car trays, and elsewhere. Then they have to spend an inordinate amount of time searching for a writing implement when they need it, often to no avail. Other people are often inconvenienced, too, such as the person waiting on the other end of a cell phone to provide a name, address, or phone number. Thus, there is a need for an easy to use writing implement that is unlikely to leak and cause damage, and is always readily available.

BRIEF SUMMARY OF THE INVENTION

The present invention is a ring pen device that is convertible between a use as a finger ring and a writing implement. The instant ring pen device includes: (a) a ring hull; (b) a hull insert within the ring hull, which includes a channel; and (c) an extendible pen assembly within the hull insert, which includes at least one ink tube. The pen assembly has a retracted position within the hull insert, and an extended position in which a portion of the ink tube is extended from an end of the channel in the hull insert. The pen assembly preferably further comprises a slide bar adjacent the ink tube, and at least one pair of matching slide bar stops extending from the slide bar on either side of the ink tube. The slide bar preferably includes a central section, a lower section attached to the ink tube, and a flexible section. The hull insert is preferably affixed to the ring hull, and comprises a cavity and at least one pair of notches in the hull insert. Each slide bar stop is insertable in at least one of the notches.

The ring pen device of the present invention overcomes the problem of digging for a writing implement in the bottom of a pocket, handbag, briefcase, knapsack, glove compartment, etc. Since a conventional pen or pencil is often difficult to locate, the ring pen device of the present invention is advantageous in that it provides the wearer with fast and easy access to a pen. At the same time, it is a stylish and novel accessory. Since it is worn on the user's finger, it is unlikely to be lost. The present ring pen device is particularly useful for the person on the go, such as a student, traveler, tourist, or salesperson, who must juggle his or her supplies or undertake other activities while attempting to take notes quickly.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1A:
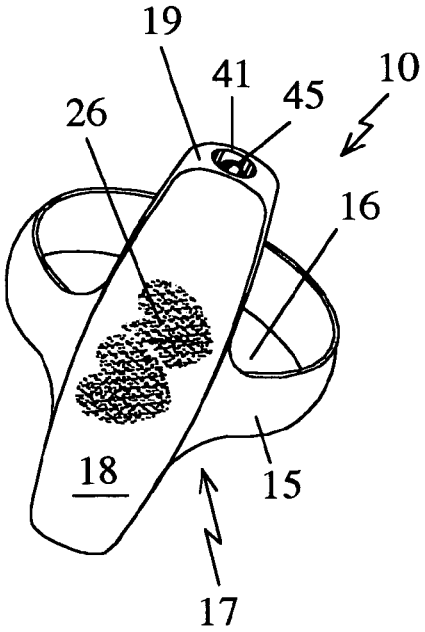
FIG. 1A is a front perspective view of a ring pen device according to the present invention, shown with a pen assembly in a retracted position.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Figure 1B:
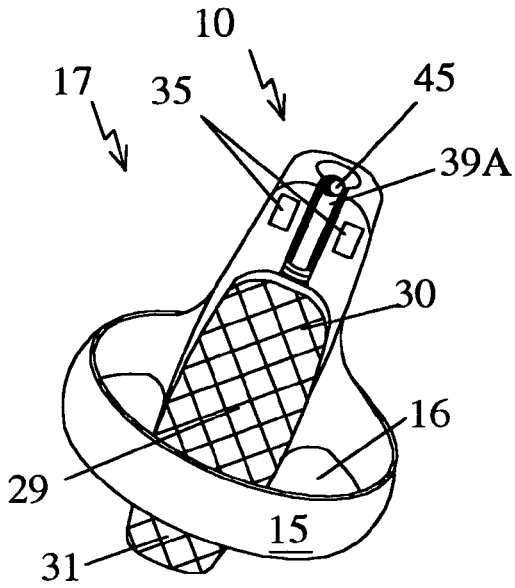
FIG. 1B is a rear perspective view of the ring pen device according to FIG. 1A.
Figure 1C:
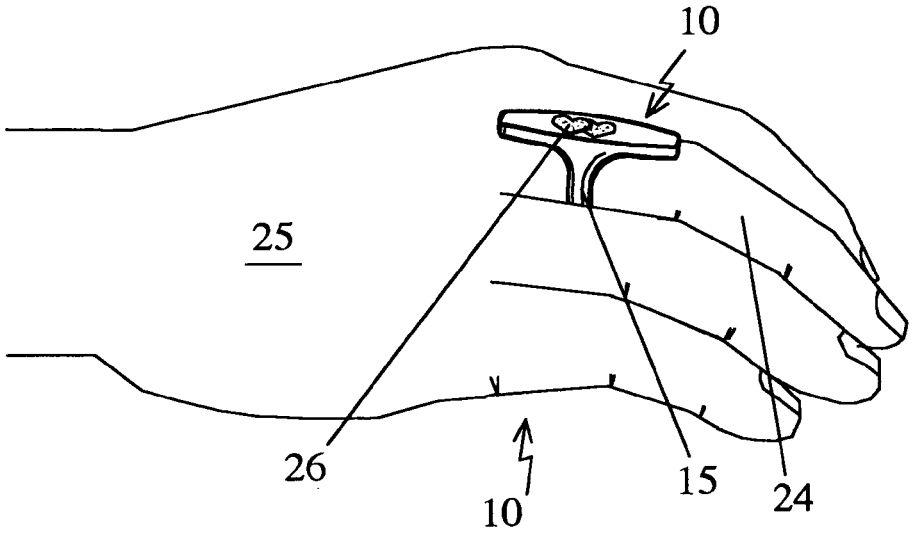
FIG. 1C shows a perspective view of a ring pen device worn according to FIG. 1A, shown on a user's hand.
Figure 2A:
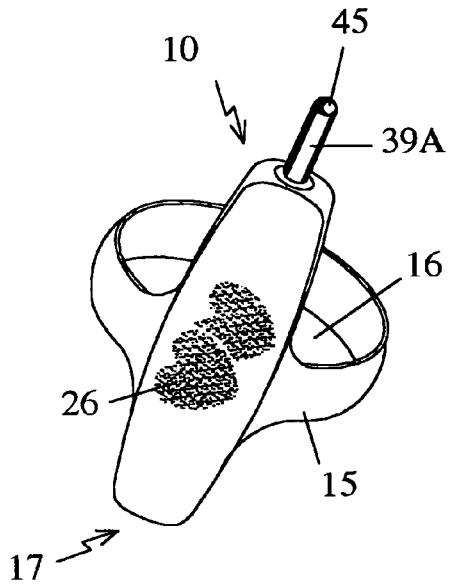
FIG. 2A is a front perspective view of a ring pen device according to the present invention, shown with a pen assembly in an extended position.
Figure 2B:
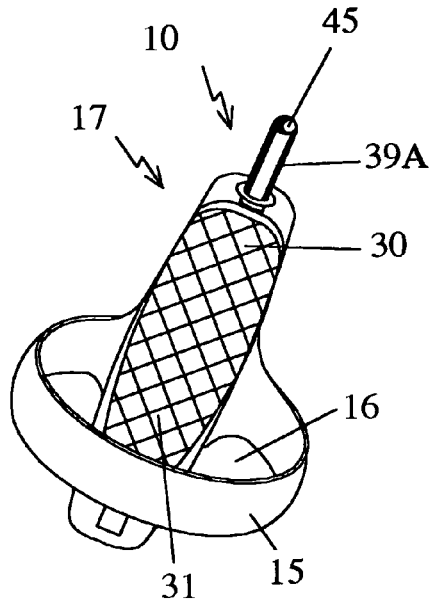
FIG. 2B is a rear perspective view of the ring pen device according to FIG. 2A.
Figure 2C:
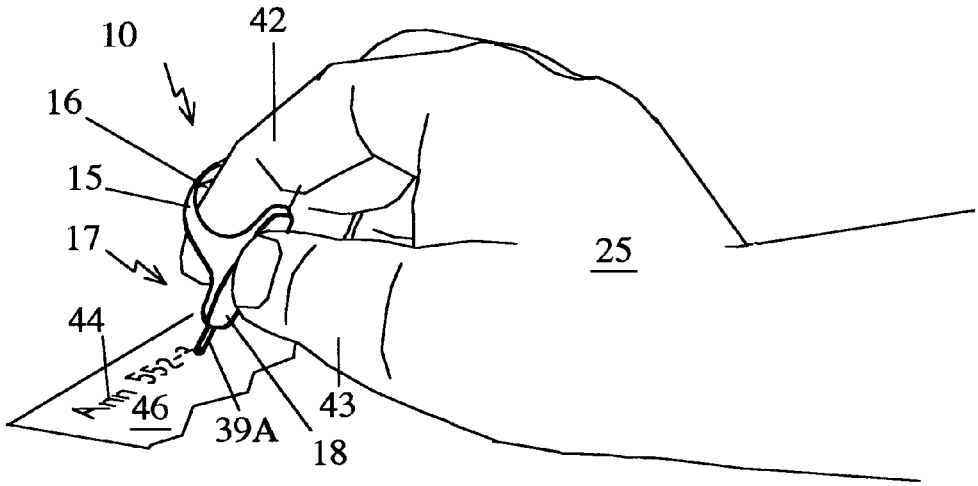
FIG. 2C is a perspective view of the ring pen device according to FIG. 2A, shown in use.

Referring to FIGS. 1A–C and 2A–C, a retractable ring pen device, generally referred to herein by reference number 10, may be worn as a finger ring and also utilized as a miniature pen. As shown in FIG. 1C, the ring pen device 10 is worn around a user's finger 24, though preferably not the thumb, with its pen assembly 13 in a retracted position when it is not being used as a writing implement. When the user desires to use the pen assembly 13 to jot down a name and telephone number, for example, as shown in FIG. 2C, the ring pen device 10 is removed from the finger 24 and held between the thumb 43 and forefinger 42 so that the user may write. This allows for a comfortable writing position and mimics the way a conventional pen is normally held. After use, the ring pen device 10 can be placed back on the finger 24, where it is readily accessible for the next time a writing implement is needed.

Figure 3:
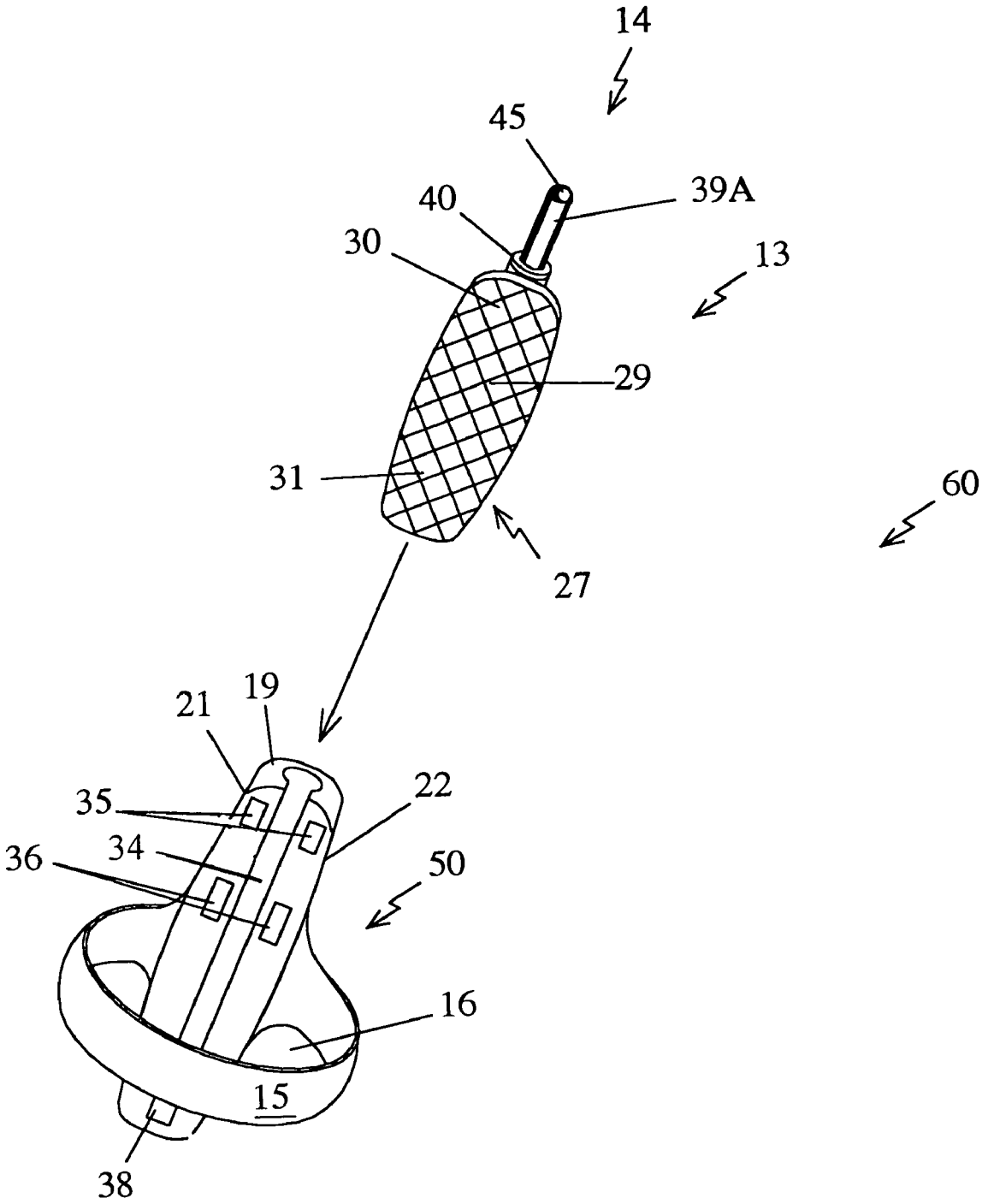
FIG. 3 is a partially exploded, perspective view of a ring pen device according to the present invention, shown with a ring hull detached from a pen assembly.
Figure 4:
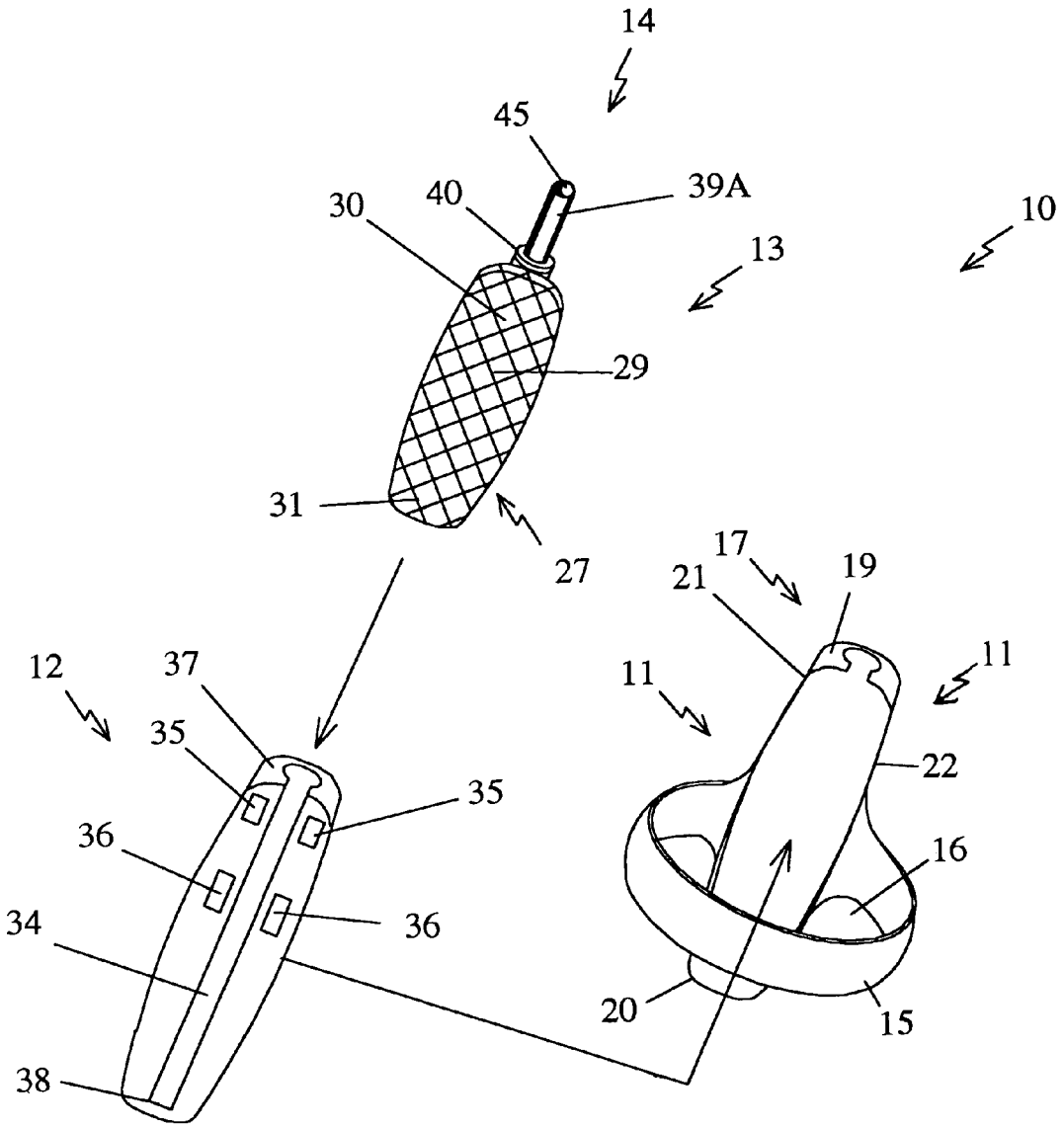
FIG. 4 is a partially exploded, perspective view of a ring pen device according to the present invention, shown with a hull insert removed from a ring hull and a pen assembly removed from the hull insert.
Figure 5C:
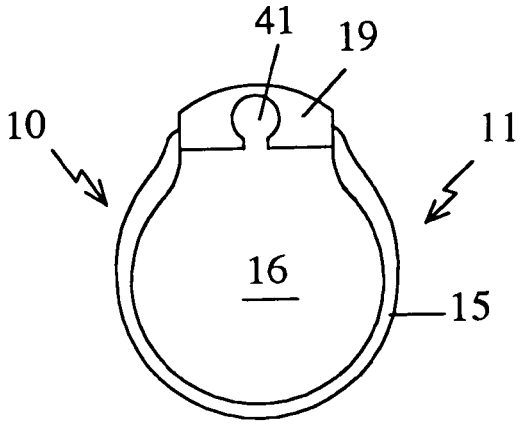
FIG. 5C is a top plan view of the ring hull according to FIG. 5A.
Figure 5B:
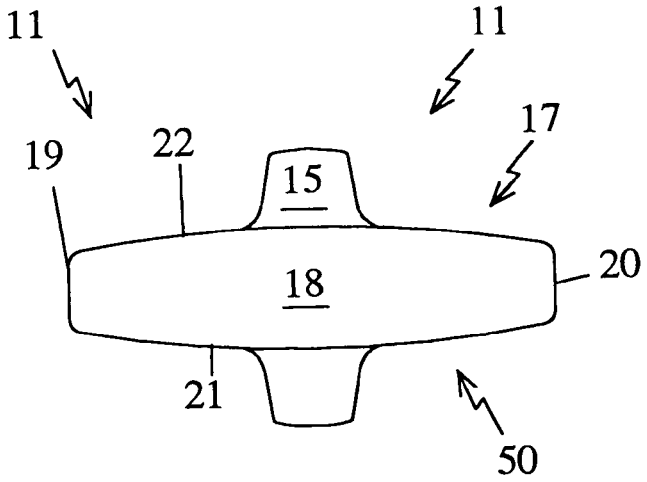
FIG. 5B is a front elevational view of the ring hull according to FIG. 5A.
Figure 5A:
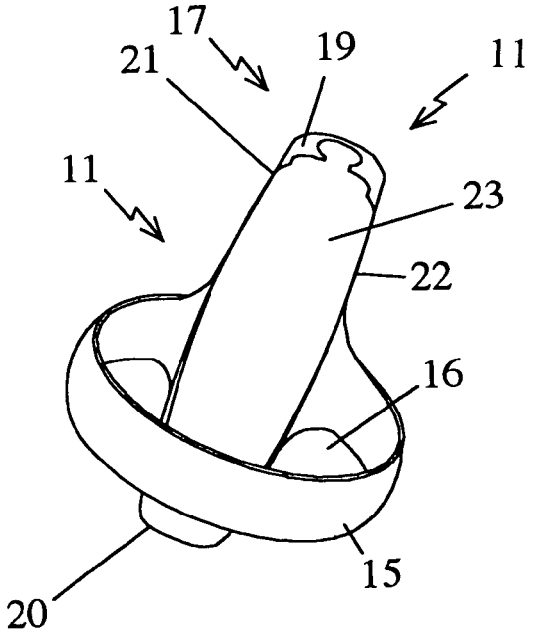
FIG. 5A is a rear perspective view of a ring hull of a ring pen device according to the present invention.
Figure 6D:
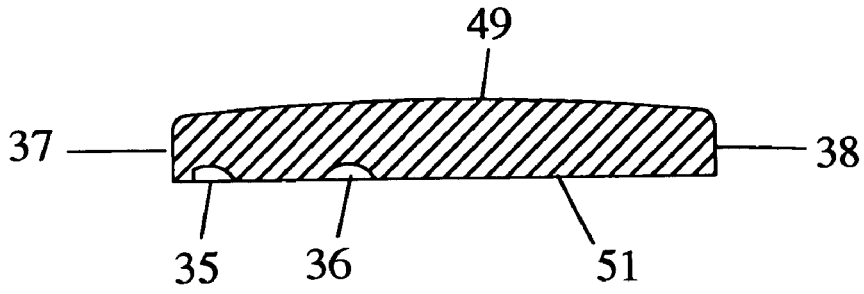
FIG. 6D is a cross-sectional view of the hull insert according to FIG. 6C.
Figure 6C:
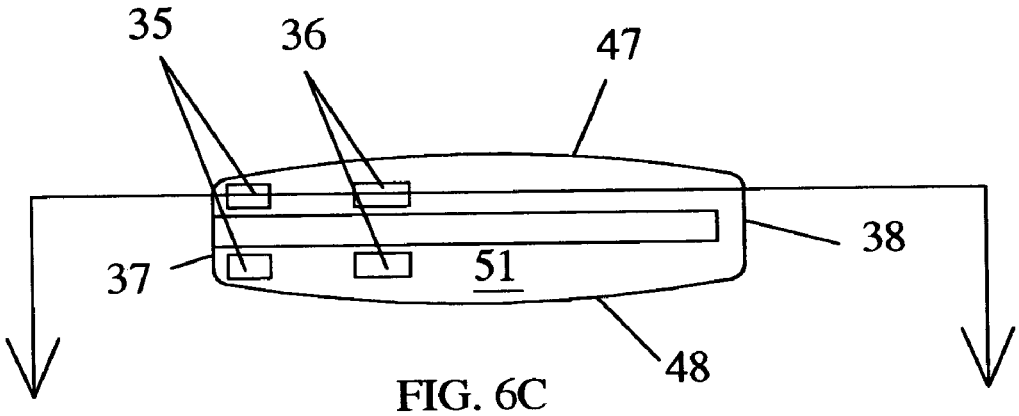
FIG. 6C is a rear elevational view of a hull insert according to FIG. 6A.
Figure 6B:
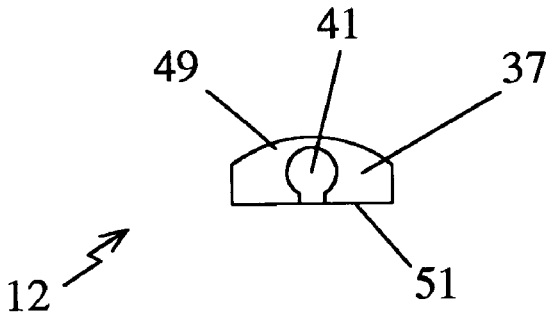
FIG. 6B is a top plan view of the hull insert according to FIG. 6A.
Figure 6A:
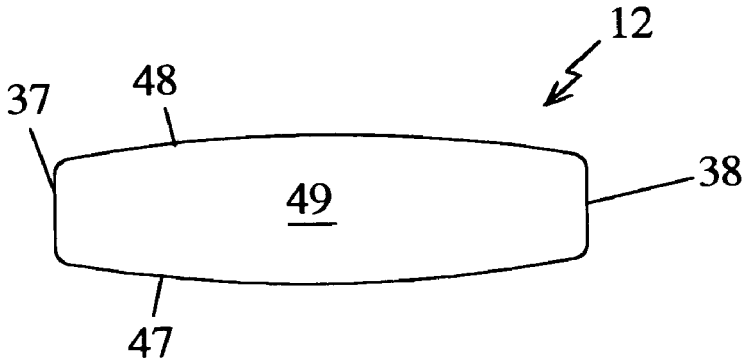
FIG. 6A is a front elevational view of the hull insert according to FIG. 4.
Figure 7A:
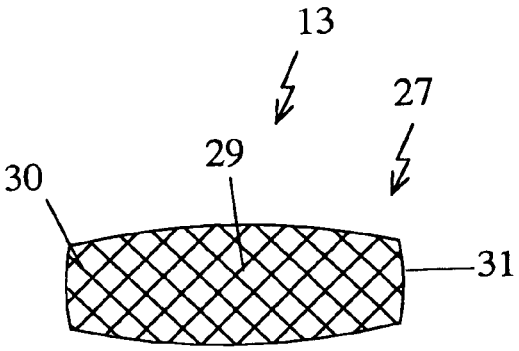
FIG. 7A is a rear elevational view of a pen assembly according to the present invention, shown without a ball point pen tip assembly.
Figure 7C:
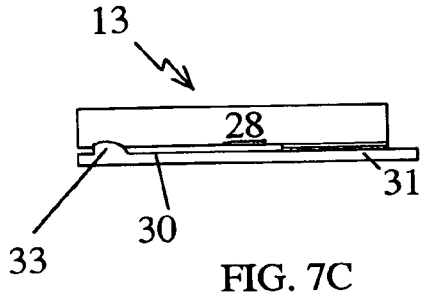
FIG. 7C is a side elevational view of a pen assembly according to FIG. 7A.
Figure 7B:
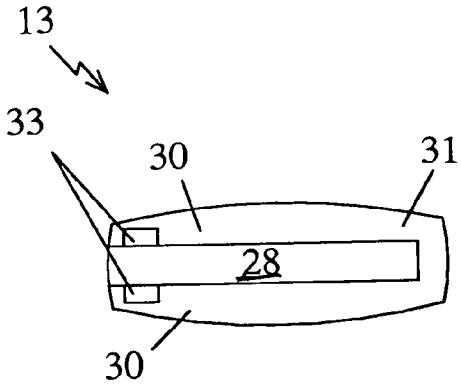
FIG. 7B is a front elevational view of a pen assembly according to FIG. 7A.
Figure 7D:
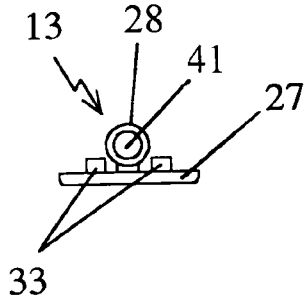
FIG. 7D is a top plan view of the pen assembly according to FIG. 7A.

As shown in FIGS. 3 and 4, a preferred embodiment of the ring pen device 10 comprises a ring hull 11, a hull insert 12, a pen assembly 13, and a ball point pen tip assembly 14. Referring to FIG. 4 and also FIGS. 5A–C, the ring hull 11 is comprised of a band portion 15 and a pen portion 17. The band portion 15 extends out from opposite faces 21, 22 of the pen portion 17 to form a circular shape that fits around a user's finger. In use, a user's finger is insertable through the generally circular aperture 16 extending through the circular band portion 15. The pen portion 17 is preferably generally rectangular in shape and has the following generally planar faces, which form a hollow: front face 18, top face 19, bottom face 20, left face 21, right face 22, and open back face 23. The open back face 23 faces the band portion 15 and is opposite the front face 18. The hull insert 12 is receivable through the open back face 23 of the pen portion 17.

Referring to FIGS. 4 and 6A–D, the hull insert 12 is insertable in the inside hollow of the pen portion 17. The hull insert 12 is therefore also generally rectangular in shape and similar in size to the hollow. The hull insert 12 is comprised of the following generally planar faces: two, opposed insert left and right side faces 47, 48, an insert bottom face 38, a partially open insert top face 37, an insert front face 49, and an open insert back face 51. The faces 37, 38, 47, 48, 49, 51 surround a uniquely shaped cavity 34, which receives the pen assembly 13. Lower and upper notches 35, 36 in the insert back face allow the pen assembly to operate and contain the pen assembly 13 in the hull insert 12.

To assemble the ring hull 11 and the hull insert 12, the manufacturer of the pen assembly glues or otherwise inserts the hull insert 12 into the hollow pen portion 17 of the ring hull 11 through its open back face 23. Within the pen portion 17, the insert front face 49 lies flush against the rear side of the front face 18 of the pen portion 17, and the open insert back face lies flush with the open back face 23 of the pen portion 17. Correspondingly, the insert left and right side faces 47, 48 lie adjacent to the left and right side faces 21 of the pen portion 17, respectively, and the insert top and bottom faces 37, 38 lie adjacent to the top and bottom side faces 19, 38 of the pen portion 17, respectively.

Referring to FIGS. 4 and 7A–D, the pen assembly 13 is slidable into and out of the hull insert 12. The pen assembly 13 is comprised of a slide bar 27, a tube 28 containing ink or another suitable marking substance adjacent the slide bar, and a pair of matching slide bar stops 33 on either side of the marking tube 28. The marking tube is preferably ink-filled. The slide bar stops 33 are preferably substantially identical. The slide bar 27 is generally rectangular in shape and the ink tube 28 is hollow and generally cylindrical in shape. The slide bar 27 comprises a central section 29, a lower section 31 where the slide bar attaches to the ink tube 28, and a flexible section 30 (see FIG. 7B–D). An ink assembly aperture 41 extends along the longitudinal center of the ink tube 28 for receiving ink and the ball point tip assembly 14 (see FIG. 7D).

To insert the pen assembly 13 into the hull insert 12, the user slides the lower section 31 of the ink tube 28 of the pen assembly 13 into the substantially similarly shaped cavity 34 in the hull insert 12 through the partially open top end 37 (see FIG. 4). The ink tube 28 fits into the cavity 34, which is molded to accommodate the ink tube 28. As the lower edge of the lower section 31 of the pen assembly 31 approaches the bottom face 38 of the hull insert 12, the slide bar stops 33 make contact with top edge of the back face 51 of the hull insert 12. The bottom side of the notches are curved, so continuing to apply pressure to the lower end of the slide bar 31 causes the slide bar stops 33 to ride up on to the back face 51 of the hull insert 12 (see FIGS. 6 and 7). This forces the flexible section 30 of the slide bar 31 to flex backwards. When the slide bar stops 33 reach the upper notches 35, they snap into the upper notches.

The pen assembly 13 is now inserted into the hull insert 12. The pen assembly is in the extended position (see FIG. 2B). Applying pressure by pushing the pen assembly 13 toward the insert bottom face 38 forces the slide bar stops 33 out of the upper notches 35, which again causes the flexible section 30 of the slide bar to flex backwards. Continuing to apply pressure to the slide bar forces it down toward the insert bottom face 38. When the lower section 31 of the pen assembly 13 reaches the bottom face 38 of the hull insert 12, the stops 33 will be aligned with the bottom set of notches 36. The slide bar stops 33 will snap into the bottom notches 36. The pen assembly 13 is now at rest in the retracted position, as shown in FIG. 1B.

To use the ring pen device 10, the user moves the pen assembly 13 to the extended position, applies pressure to the lower section 31 of the slide bar 27, pushing the pen assembly 13 toward the top face 19 of the hull insert. This forces the slide bar stops 33 out of the bottom notches 36, which are curved to allow this action, and up onto the back face of the hull insert 51. Continuing to apply pressure will move the pen assembly toward the insert top face 37. When the stops 33 reach the upper notches 35, they snap into the upper notches 35. The pen assembly is now in the extended position, as shown in FIG. 2B.

The topside of the upper notches 35 are made on approximately a 90 degree angle in relation to the movement of the pen assembly 13. The upper notches 35 are similarly shaped in order to provide a stop for the pen assembly 13. This prevents the pen assembly 13 from being pushed out of the hull insert when the pen assembly 13 is moved from the retracted position to the extended position.

To remove the pen assembly 13 from the hull insert 12, the user starts with the pen assembly 13 in the extended position. While gently applying pressure on the lower end of the slide bar 27 in the direction of the insert top face 37, the user lifts up slightly on the end of the slide bar. This pulls the slide bar stops 33 out of the upper notches 36. The pen assembly 13 will now slip out of the hull insert 12.

When the ring pen device 10 no longer works, it may be disposed of appropriately and easily replaced, since it is inexpensive. An alternate embodiment is refilled by removing the pen assembly and replacing it with a new one.

Figure 8B:
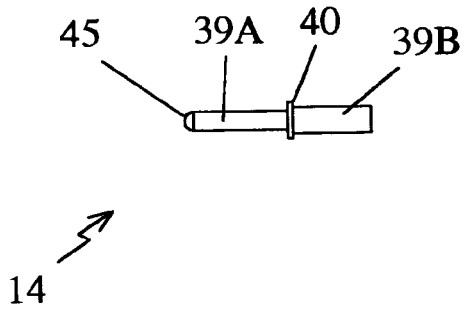
FIG. 8B is a side elevational view of the ball point pen tip assembly according to FIG. 8A.
Figure 8A:
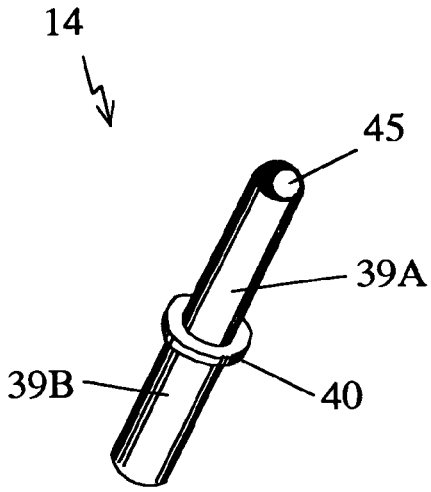
FIG. 8A is a perspective view of a ball point tip assembly according to the present invention.

Turning to FIGS. 8A–B, a preferred ball point tip assembly 14 is comprised of an upper ink barrel section 39*a* and a lower ink barrel section 39*b* joined by a stop ring 40. The ink barrel sections 39*a*, 39*b* are substantially longitudinally oriented. The lower ink barrel section 39*b* has a greater diameter than the diameter of the lower ink barrel section 39*a*. The lower ink barrel section 39*b* fits the ink tube 28. The stop ring 40 prevents the barrel from sliding up into the ink tube 28. The upper ink barrel section 39*a* forms the writing tip.

To use the ring pen device 10 as a pen, the user simply slides the pen assembly 13 longitudinally through the cavity 34 so that the stops 33 disengage the lower notches 36 and engage the upper notches 35. As a result, the pen assembly 13 is in the extended position as shown in FIGS. 2A–C; the upper ink barrel section 39*a* extends from the top face 37 of the ring hull 11. Then, in order to write, the user inserts his or her forefinger 42 through the band aperture 16 and holds the ring portion 17 between his or her forefinger 42 and thumb 43, so that the front face 18 faces the user and the upper ink barrel section 39*a* points in a generally downward direction. As the user writes, ink 44 from the marking tube 28 flows through the lower ink barrel section 39*b* out of a tip 45 of the upper ink barrel section 39*a*, and onto the writing surface 46, as shown in FIG. 2C. The word "ink" as used herein means any type of writing medium including pen ink.

To wear the ring pen device 10, the user gently slides the pen assembly 13 back into the cavity 34, so that the slide bar stops 33 disengage the upper notches 35 and engage 36 the lower notches 36. As a result, the entire pen assembly 13 is in a retracted position within the cavity 34, where the upper ink barrel section 39*a* is concealed by the top face 37 of the ring hull 11, as depicted in FIGS. 1A and 1B. Then the user inserts his or her ring finger 24, or any other finger, through the aperture 16 with the pen assembly 13 lying against the top side of his or her finger between the hand and the finger knuckle.

According to the preferred embodiment of the of the ring pen device 10, the hull insert 12 is fixed in the pen portion 17 of the ring hull 11, the pen assembly 13 is removably insertable in the cavity 34 of the hull insert 12, and the ball point tip assembly 14 is affixed in the pen assembly aperture 41 of the pen assembly 13.

The ring hull 11 is preferably made of a precious metal, such as gold or silver, for durability and attractiveness. The hull insert 12 is preferably made of a durable plastic material. The pen assembly 13 is preferably disposable, inexpensive, and easy to manufacture. The hull insert 12 and the pen assembly 13 may be constructed from plastic. Having a ring hull 11 separate from a hull insert 12 is advantageous in that the ring pen device is less costly and lighter in weight when the ring hull is made of a precious metal and the hull insert is made of a plastic material rather than the precious metal.

FIG. 3 shows an alternate embodiment of the ring pen device 60, in which the hull insert 12 is integral with the ring hull 11. In this embodiment, both the ring hull 11 and the hull insert 12, which form a ring hull/hull insert 50, are preferably made of a durable plastic. An integral ring hull 11/hull insert 12 is advantageous in that it is inexpensive to manufacture.

Figure 9:
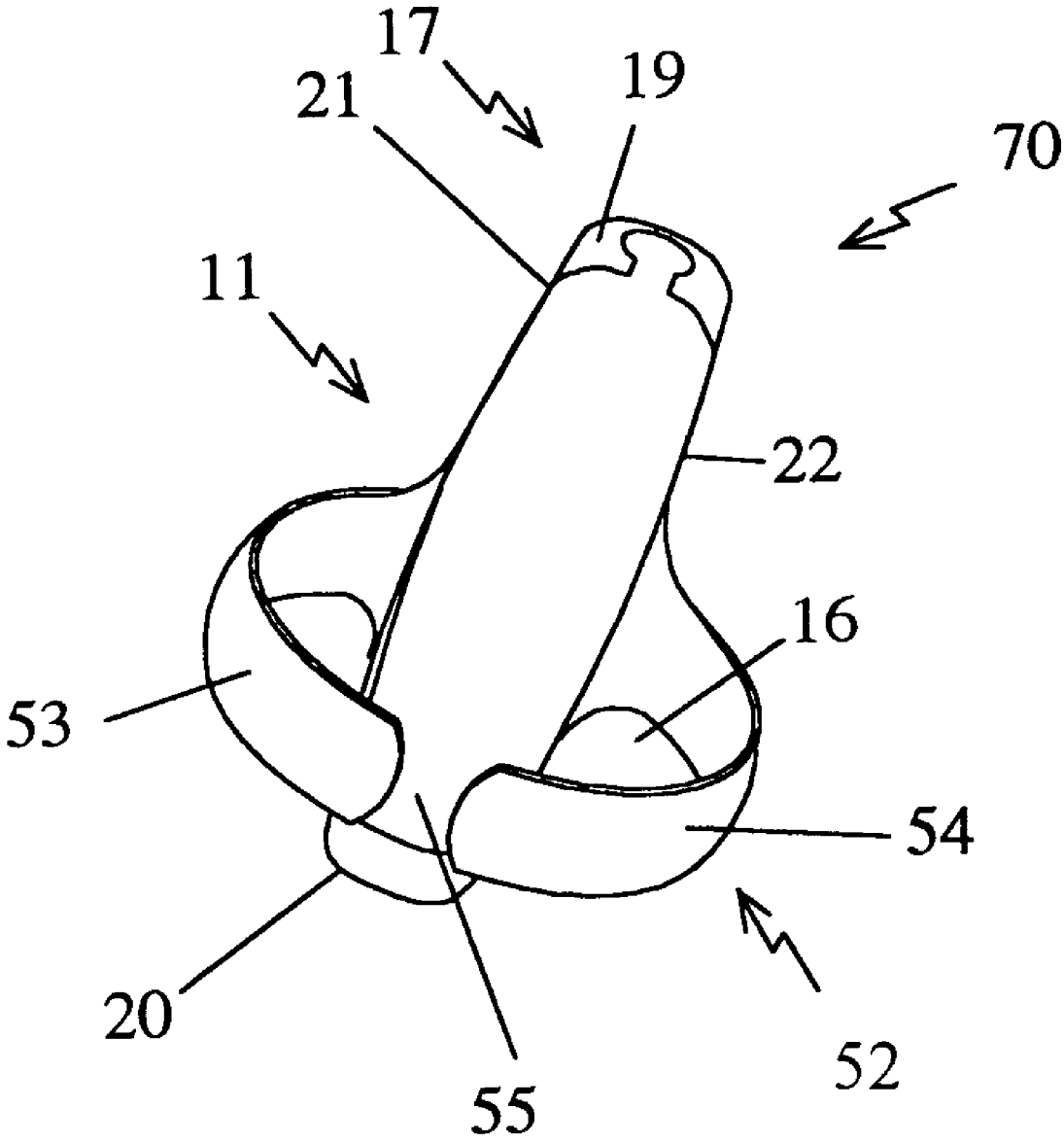
FIG. 9 is a perspective view of a ring hull of a ring pen device according to the present invention, shown with an adjustable band.

The band portion 15 of the ring pen device 10, 60 can be made in a variety of different sizes (i.e., the circumference of the band portion 15 can be manufactured in different lengths), or the band portion may be adjustable so that it fits different fingers of different users, as in the embodiment 70 shown in FIG. 9. As illustrated in FIG. 9, the ring hull 11 has an adjustable band 52, which is non-contiguous. A first band section 53 projects from the left (or first) face 21 of the ring hull 11, and a second, mirror image band section 54 projects from the right (or second) face 22 of the ring hull 11. A gap 55 between the two band sections 53, 54 allows for adjustment. In use, these band sections 53, 54 flex slightly about the two faces 21, 22. To decrease the circumference of the adjustable band 52, the user pushes the band sections 53, 54 together into the gap 55. To increase the circumference of the adjustable band 52, the user pulls the band sections 53, 54 away from one another, thus increasing the gap 55 and the fit.

Figure 10:
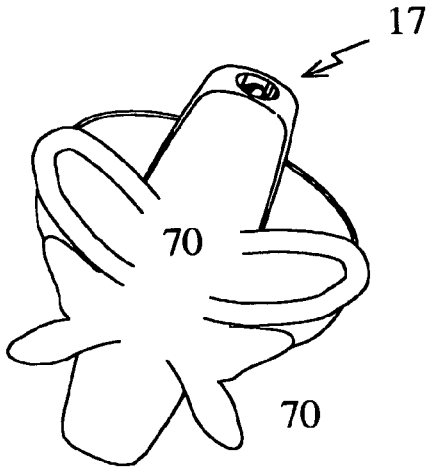
FIGS. 10–14 show front perspective views of ring pen devices according to the present invention.
Figure 11:
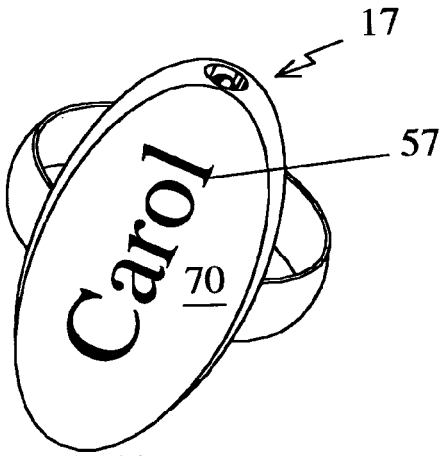
Figure 13:
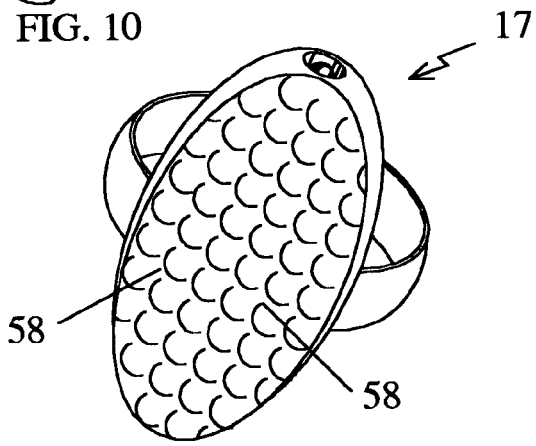
Figure 12:
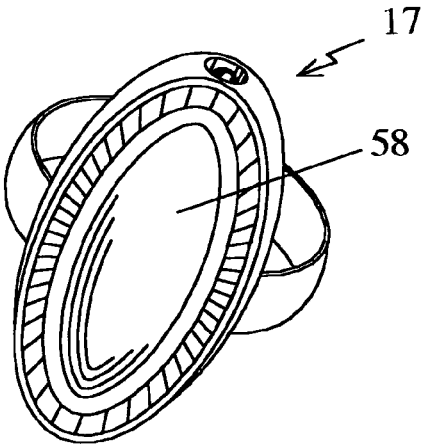
Figure 14:
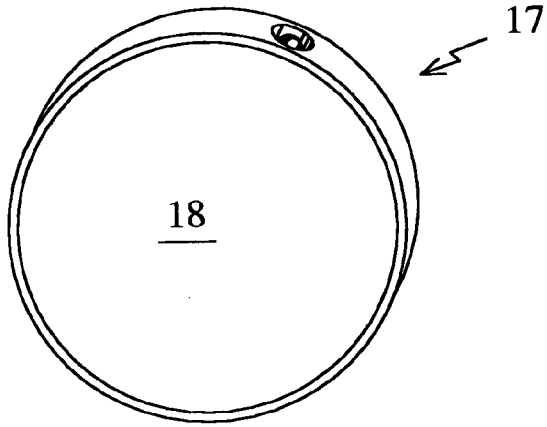
Figure 15:
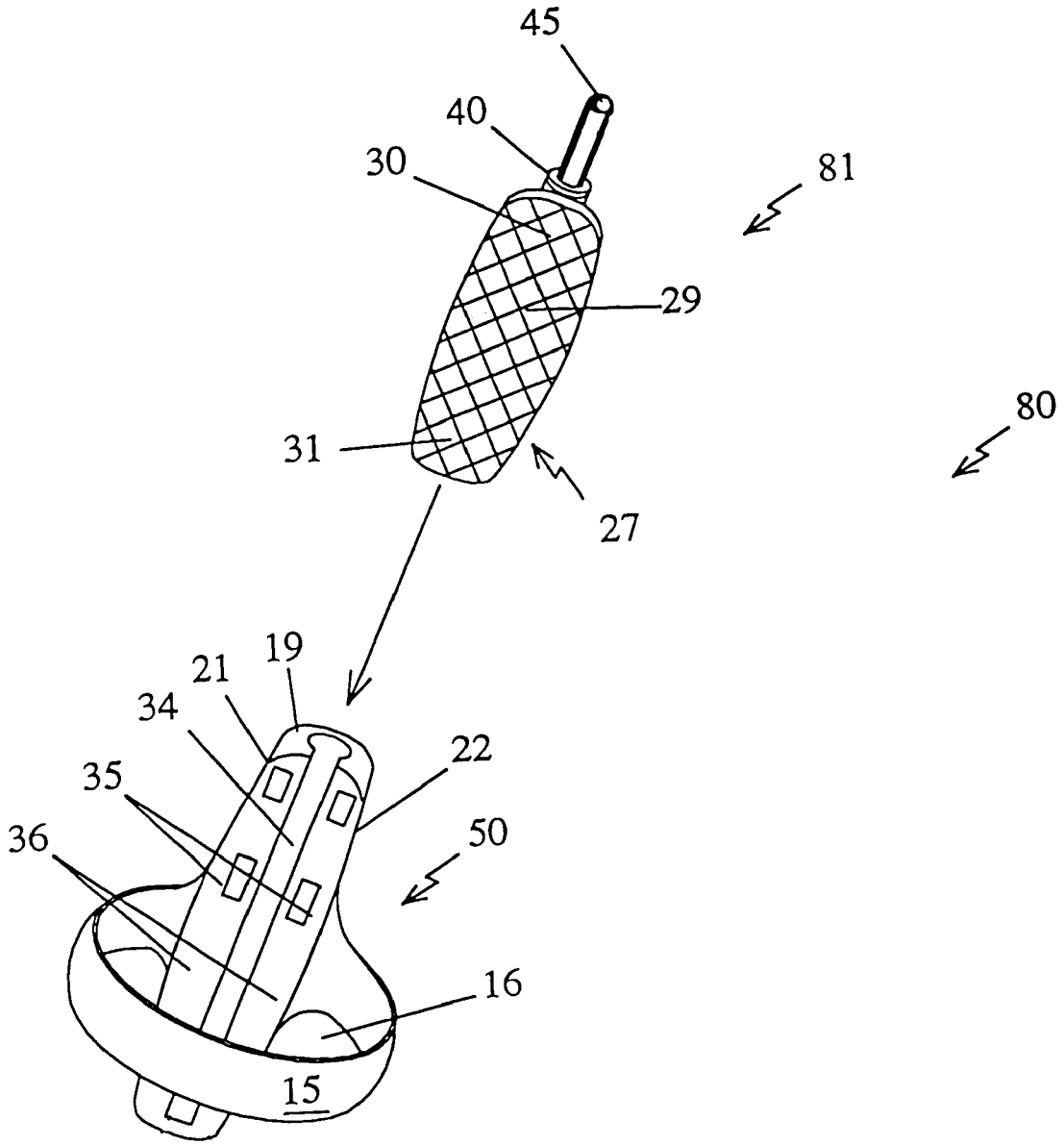
FIG. 15 is a partially exploded, perspective view of a ring pen device according to the present invention, shown with a ring hull detached from a pen assembly.

FIGS. 10–14 depict alternate embodiments of the ring pen device of the present invention, in which the pen portion 17 is not generally rectangular in shape. FIGS. 11, 12, and 13 illustrate a ring pen device with a pen portion 17 that is generally ovular in shape, while FIG. 15 illustrates a ring pen device with a pen portion 17 that is generally circular in shape. Other shapes may also be used. In the embodiments shown, the pen portion 17 still comprises a generally planar, open back face 23 so that it rests substantially flush against a user's finger when worn by the user. Whatever the shape of the pen portion 17, it accommodates a hull insert 12. The ring pen device may include decorative objects or designs on the front face 18 of the pen portion 17. These objects or designs may be integral with or attached to the front face 18. Exemplary designs include a butterfly shape 56, as shown in FIG. 10, a personalization 57 (e.g., user's name or initials) or other word, as shown in FIG. 11, and interlocking hearts 26, as shown in FIG. 1A. Exemplary objects include at least one jewel or stone (natural or imitation) 58, shown in FIGS. 12 and 14. Of course, the front face 18 of the ring hull 11 need not include any object or design.

As shown in the alternate embodiment 80 of FIG. 15, an alternative type of marking assembly may be employed instead of a ball point tip assembly 14, such as a felt tip assembly, a marker assembly 81, and a roller tip ink assembly. Included in the present invention is a ring pen kit for assembling a ring pen device. The ring pen kit comprises: (a) a ring hull 11; (b) a hull insert 12 insertable in a cavity 34 in the ring hull 11; (c) a detachable, extendible pen assembly 13 within the hull insert 12; (d) a detachable, extendible felt tip assembly; (e) a detachable, extendible marker assembly 81; and (f) a detachable, extendible roller tip ink assembly. The hull insert 12 comprises a channel 32. The pen assembly 13 comprises at least one marking tube 39, as described herein, preferably an ink-filled tube made of plastic or the like. Each of the assemblies (pen, felt, marker, roller) has a retracted position within the hull insert 12, and an extended position in which a marking portion of the assembly, such as the ink tube 39 of the pen assembly 13, extends from an end of the channel 32 in the hull insert 12. As described herein, the hull insert 12 comprises at least one pair of notches 35, 36, the pen assembly 13 comprises a slide bar 27, the slide bar 27 comprises at least one pair of matching stops 33 extending from the slide bar 27, and each slide bar stop 33 is removably engageable with one of the notches 39.

Figure 16:
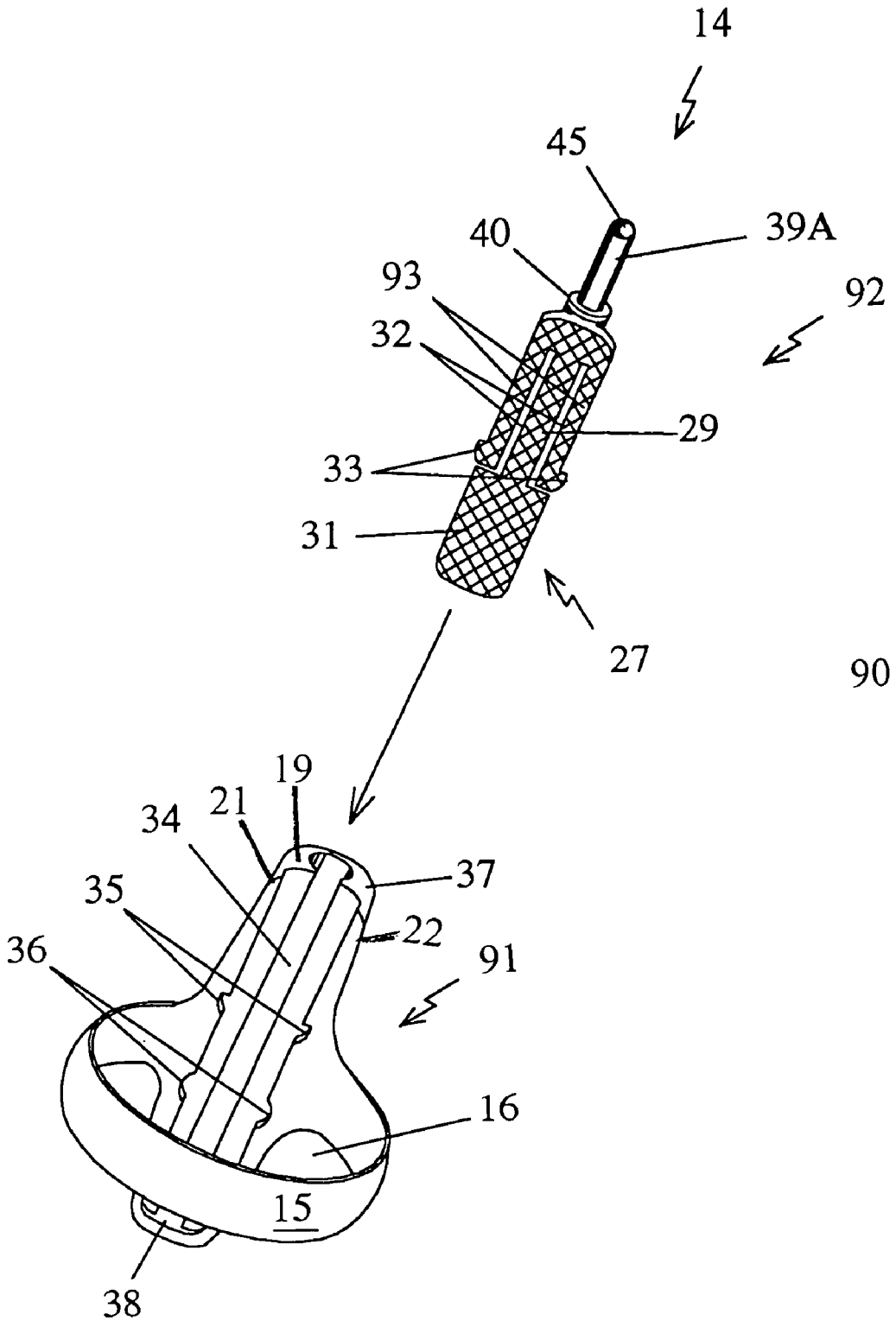
FIG. 16 is a perspective view of a ring pen device according to the present invention, shown with a ring hull detached from a pen assembly.
Figure 17:
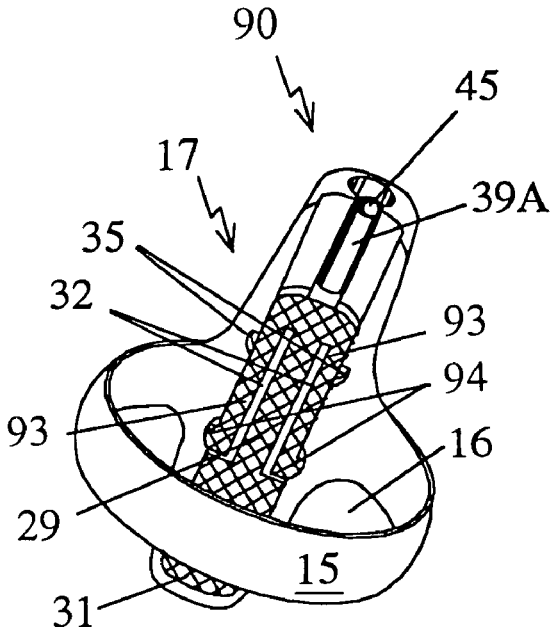
FIG. 17 is a rear perspective view of the ring pen device according to FIG. 16, shown with a pen assembly in a retracted position.
Figure 18:
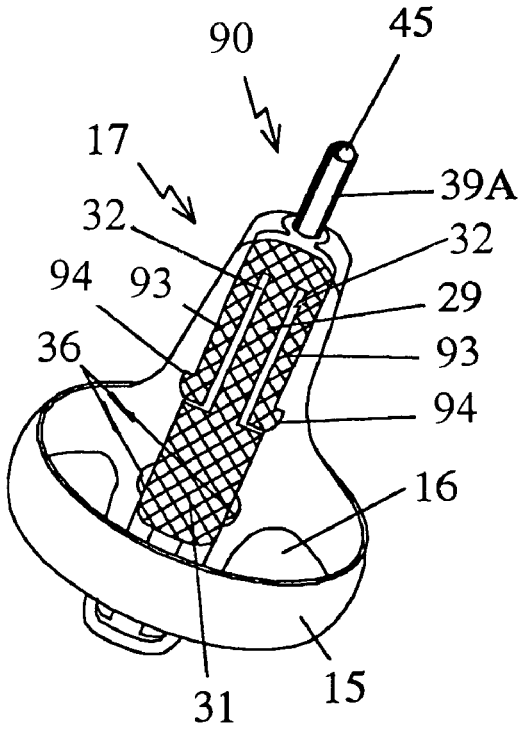
FIG. 18 is a rear perspective view of the ring pen device according to FIG. 16, shown with a pen assembly in an extended position.

FIGS. 16 through 18 depict an alternate embodiment 90 of the ring pen device of the present invention, which comprises a ring hull 11, a hull insert 91, a pen assembly 92, and a ball point pen tip assembly 14 (see FIG. 16). The ring hull 11 is comprised of a band portion 15 and a pen portion 17. The band portion 15 extends from opposite faces 21, 22 of the pen portion 17 to form a circle that fits around a user's finger. The band portion 15 has a generally circular aperture 16 extending through it for accommodating a user's finger. The pen portion 17 is generally rectangular in shape and has the following generally planar faces: front face 18, top face 19, bottom face 20, left face 21, right face 22, and open back face 23. The open back face 23 faces the band portion 15 and is opposite the front face 18.

The pen assembly 92 of this slide arm embodiment 90 is slidable into and out of a slide arm hull insert 91. The slide arm hull insert 91, which is receivable through the open back face 23 of the pen portion 17, may be integral with the ring hull 11, or it may be detachable from the ring hull. The slide arm pen assembly 92 is comprised of a slide bar 27 attached to an ink tube 28. The slide bar 27 is generally rectangular in shape and the ink tube 28 is hollow and generally cylindrical in shape.

The slide bar 27 is comprised of a central section 29, a lower section 31, and two flexible, matching side arms 93, as shown in FIGS. 16–18. Both the central and lower sections 29, 31 of the pen assembly are generally rectangular in shape, with the lower section 31 having a width slightly greater than a width of the central section 29. The slide arms 93 protrude from an upper end of a central section 29 and extend longitudinally along the length of the central section 29 and are separated by channels 32 from the central section 29. Two mirror image slide arm stops 94 project substantially perpendicularly from the slide arms 93 away from the channels 32 and the central section 29. Likewise, the lower section 31 protrudes from a lower end of the central section 29. The ink tube 28 is affixed to a rear side of the slide bar 27 and extends between the upper end of the central section 29 and the lower end of the lower section 31. A preferred ball point tip assembly 14 is comprised of an upper ink barrel section 39*a* and a lower ink barrel section 39*b* joined by a stop ring 40, as described herein.

As shown in FIG. 16, the slide bar 27 fits into a first part of the cavity 34, which is molded to accommodate the slide bar 27, and the ink tube 28 fits into a second part of the cavity 34, which is molded to accommodate the ink tube 28. In use, as the lower edge of the lower section 31 approaches the bottom face 38 of the slide arm hull insert 91, the slide arm stops 94 contact the top side 37 of the hull insert 91. The user then exerts a downward force on the slide arm pen assembly 92. Due to the curvature of the slide arm stops 94, the slide arms 93 flex slightly inwardly into the channels 32 when the slide arm stops are pressed against the top face 37. The slide arm stops 94 clear the top end 37. The user continues to push the pen assembly generally downward into the cavity 34. The walls of the cavity 34 continue to retain the arms in the channels 32 and the stops 94 continue to slide by the sides of the cavity 34 until they reach the upper notches 35. Upon alignment of the slide arm stops with the upper notches 35, inwardly directed pressure is no longer exerted on the stops 94; thus, they move out of the channels 32 and engage the upper notches 35. At this point, the pen assembly is ready for use in an extended position, as shown in FIG. 18.

Again the user exerts generally downwardly directed pressure on the pen assembly 92 so that the walls of the cavity exert generally inwardly directed pressure on the slide arm stops 94, the slide arms 93 flex into the channels 32, the slide arm stops 94 disengage the upper notches 35, and pen assembly 92 slides further down into the cavity 34. Upon alignment of the slide arm stops 94 with the lower notches 36, the walls of the cavity 34 no longer exert generally inwardly directed pressure on the slide arms 93, and the slide arm stops 94 engage the lower notches 36. At this point, a lower edge of the lower section 31 contacts the bottom side 38 of the hull insert 12, and the pen assembly 92 is in the retracted position, as depicted in FIG. 17.

From the foregoing it can be realized that the described device of the present invention may be easily and conveniently utilized as a ring pen device for dual use as a piece of jewelry and a writing implement. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 ring pen device
11 ring hull
12 hull insert
13 pen assembly
14 ball point tip assembly
15 band portion
16 band aperture
17 pen portion
18 front face
19 top face
20 bottom face
21 left face
22 right face
23 back face
24 finger
25 back of hand
26 hearts design
27 slide bar
28 marking/ink tube
29 slide bar central section
30 slide bar flexible section
31 slide bar lower section
32 channel
33 stops on slide bar
34 cavity
35 upper notches

36 lower notches
37 insert top face
38 insert bottom face
39*a* upper ink barrel section
39*b* lower ink barrel section
40 stop ring
41 ink assembly aperture
42 forefinger
43 thumb
44 ink
45 tip
46 writing surface
47 insert left face
48 insert right face
49 insert front face
50 integral ring hull/hull insert
51 insert back face
52 adjustable band
53 first band section
54 second band section
55 gap
56 butterfly
57 personalization
58 jewel or stone
60 ring pen device, alternate embodiment
70 ring pen device, alternate embodiment
80 ring pen device, alternate embodiment
81 marker assembly
90 ring pen device, alternate embodiment
91 pen assembly of slide arm embodiment
92 ring hull of slide arm embodiment
93 slide arm
94 slide arm stop

What is claimed is:

1. A ring pen device for use as a finger ring and a writing implement, the ring pen device comprising:

(a) a ring hull;

(b) a hull insert that is insertable within the ring hull, the hull insert comprising a channel; and (c) an extendible pen assembly within the hull insert, the pen assembly comprising at least one marking tube, a slide bar adjacent the marking tube, and at least one pair of matching slide bar stops extending from the slide bar on either side of the marking tube;

wherein the pen assembly has a retracted position within the hull insert, and an extended position in which a portion of the marking tube extends from an end of the channel in the hull insert.

2. The ring pen device according to claim 1, wherein the the marking tube being an ink-filled tube.

3. The ring pen device according to claim 2, wherein the slide bar comprises a central section, a lower section attached to the ink tube, and a flexible section, the slide bar stops being attached to a rear face of the flexible section.

4. The ring pen device according to claim 2, wherein the hull insert is affixed to the ring hull, the hull insert comprising a cavity and at least one pair of notches in the hull insert, each slide bar stop being insertable in at least one of the notches.

5. The ring pen device according to claim 1, wherein the ring hull is comprised of a band portion and a pen portion, the band portion projecting from and partially encircling the pen portion, and the pen portion supporting the hull insert, and wherein a generally circular aperture extends through the band portion.

6. The ring pen device according to claim 5, wherein the band portion is adjustable.

7. The ring pen device according to claim 5, the band portion comprising a first band section and a second band section, the first band section projecting from a first face of the pen portion and being flexible about the first face, the second band section projecting from a second face of the pen portion and being flexible about the second face, and wherein the first band section and second band section are separated by a gap, and the band sections are reversibly moveable toward one another into the gap.

8. The ring pen device according to claim 5, wherein the pen portion of the ring hull is generally ovular or circular in shape, and comprises a personalization.

9. A ring pen device that is a finger ring and a writing implement, the ring pen device comprising:

(a) a ring hull;

(b) a hull insert that is insertable within the ring hull, the hull insert comprising a central channel and at least one pair of notches in the hull insert; and (c) an extendible pen assembly in the hull insert, the pen assembly comprising a slide bar, at least one pair of matching stops extending from the slide bar, and at least one marking tube adjacent the slide bar, each stop being removably engageable with at least one of the notches;

wherein the pen assembly has a retracted position within the hull insert, and an alternate, extended position in which an end portion of the marking tube extends from an end of the channel in the hull insert.

10. The ring pen device according to claim 9, wherein the hull insert comprises a central cavity and an upper pair of the notches, the upper pair of notches being aligned with one another and on opposite sides of the cavity, and a lower pair of the notches, the lower pair of notches being aligned with one another and on opposite sides of the cavity.

11. The ring pen device according to claim 10, wherein the slide bar comprises a central section and a pair of flexible, mirror image slide arms projecting from the central section and extending longitudinally along opposite side of the central section, the slide arms being reversibly movable in channels between the central section and the slide arms.

12. The ring pen device according to claim 11, wherein the marking tube is an ink-filled tube, and the pen assembly further comprises a ball point tip assembly projecting from an end of the ink tube.

13. The ring pen device according to claim 12, wherein the ink tube extends along a longitudinal axis of the ring pen device along a rear side of the slide bar, the ink tube comprising an ink assembly aperture extending along a longitudinal axis of the ink tube, the ball point tip assembly being removably insertable in the ink assembly aperture.

14. The ring pen device according to claim 12, wherein the pen assembly is slideable on a longitudinal axis along the cavity between the retracted position and the extended position, wherein in the retracted position the slide bar stops are engaged with the lower pair of notches, and in the extended position the slide bar stops are engaged with the upper pair of notches and the portion of the ink tube extends beyond a top face of the pen portion.

15. The ring pen device according to claim 12, wherein the ball point tip assembly comprises an upper ink barrel section, a lower ink barrel section, and a stop ring, the upper ink barrel section being longitudinally aligned with the lower ink barrel section, the upper ink barrel section and the lower ink barrel section being joined by the stop ring.

16. The ring pen device according to claim 15, wherein the lower ink barrel section is removably insertable in the ink assembly aperture, the upper ink barrel section extends from the ink assembly aperture, and the stop ring stops the upper ink barrel section from entering the ink assembly aperture.

17. The ring pen device according to claim 9, wherein the hull insert is integral with the ring hull, forming an integral ring hull/hull insert.

18. The ring pen device according to claim 17, wherein the ring hull is made of metal, and the integral ring hull/hull insert is made of plastic.

19. A ring pen kit for assembling a ring pen device, the kit comprising:

(a) a ring hull;

(b) a hull insert insertable in a cavity in the ring hull, the hull insert comprising a channel;

(c) a detachable, extendible pen assembly within the hull insert, the pen assembly comprising at least one marking tube, a slide bar adjacent the marking tube, and at least one pair of matching slide bar stops extending from the slide bar on either side of the marking tube;

(d) a detachable, extendible felt tip assembly;

(e) a detachable, extendible marker assembly; and (f) a detachable, extendible roller tip ink assembly;

wherein each of the assemblies has a retracted position within the hull insert, and an extended position in which a marking portion of the assembly extends from an end of the channel in the hull insert.

20. The ring pen kit according to claim 19, wherein the hull insert comprises at least one pair of notches, and the pen assembly comprises a slide bar, the slide bar comprising at least one pair of matching stops extending from the slide arm, each stop being removably engageable with one of the notches.

* * * * *